US009708785B1

(12) United States Patent
Bollman et al.

(10) Patent No.: US 9,708,785 B1
(45) Date of Patent: Jul. 18, 2017

(54) PORTABLE FLOOD CONTROL APPARATUS

(71) Applicants: Jimmy Bollman, Oklahoma City, OK (US); Patrick Han, Edmond, OK (US); Connor Begansky, Edmond, OK (US); Colton Cammack, Oklahoma City, OK (US)

(72) Inventors: Jimmy Bollman, Oklahoma City, OK (US); Patrick Han, Edmond, OK (US); Connor Begansky, Edmond, OK (US); Colton Cammack, Oklahoma City, OK (US)

( * ) Notice: Subject to any disclaimer, the term of this patent is extended or adjusted under 35 U.S.C. 154(b) by 0 days.

(21) Appl. No.: 14/999,242

(22) Filed: Apr. 13, 2016

(51) Int. Cl.

| | |
|---|---|
| ***E02B 7/08*** | (2006.01) |
| ***E02B 7/20*** | (2006.01) |
| ***E02B 7/50*** | (2006.01) |
| ***E02B 3/10*** | (2006.01) |

(52) U.S. Cl.
CPC ..... *E02B 3/106* (2013.01)

(58) Field of Classification Search
CPC ... E02B 3/04; E02B 3/06; E02B 3/062; E02B 3/10; E02B 3/104; E02B 3/106; E02B 3/108; E02B 15/0814; E02B 15/0864; E02B 7/005; E04H 9/145; E06B 9/02; E06B 2009/007
USPC ..... 405/21, 28, 32, 68, 80, 87, 91, 92, 96, 405/107, 110, 111, 114, 115
See application file for complete search history.

(56) References Cited

U.S. PATENT DOCUMENTS

| | | | | |
|---|---|---|---|---|
| 4,252,461 | A * | 2/1981 | Colamussi | E02B 7/005 405/115 |
| 4,488,386 | A * | 12/1984 | Thompson | E04G 21/24 160/23.1 |
| 4,657,433 | A * | 4/1987 | Holmberg | E02B 3/04 405/21 |
| 5,197,821 | A | 3/1993 | Cain | |
| 5,238,327 | A * | 8/1993 | Blair | E02B 15/08 405/68 |
| 5,645,373 | A | 7/1997 | Jenkins | |
| 5,865,564 | A | 2/1999 | Miller | |
| 5,984,577 | A | 11/1999 | Strong | |
| 5,988,946 | A * | 11/1999 | Reed | E02B 3/102 405/114 |
| 6,551,025 | B2 | 4/2003 | Dery | |
| 7,357,598 | B1 * | 4/2008 | Bradley | E02B 3/108 405/111 |
| 7,712,998 | B2 | 5/2010 | Salemie | |
| 2001/0014256 | A1 * | 8/2001 | Carnahan | E02B 3/046 405/111 |
| 2008/0008533 | A1 * | 1/2008 | Rehn | E04H 9/145 405/114 |

(Continued)

*Primary Examiner* — Frederick L Lagman
*Assistant Examiner* — Stacy Warren
(74) *Attorney, Agent, or Firm* — Randal D. Homburg

(57) ABSTRACT

A portable ground deployed flood barrier for the protection of a structure against tidal or ground surface flooding provides a lower cylindrical ground tube placed on the ground against the structure base, an upper cylindrical float tube and an intermediate sheet material attaching between the ground tube and the float tube which is presented as folded but readily spread vertically as the flood waters rise, causing the float tube to rise to the water level while leaving the ground tube in contact with the ground surface forming a water proof barrier for the structure against the flood waters.

4 Claims, 6 Drawing Sheets

(56) References Cited

U.S. PATENT DOCUMENTS

2013/0302092 A1* 11/2013 Ortiz ..... E06B 9/00
405/36

* cited by examiner

PORTABLE FLOOD CONTROL APPARATUS

CROSS REFERENCE TO RELATED APPLICATIONS

None.

I. BACKGROUND OF THE INVENTION

1. Field of Invention

A portable ground deployed flood barrier for the protection of a structure against tidal or ground surface flooding provides a lower cylindrical ground tube placed on the ground against the structure base, an upper cylindrical float tube and an intermediate sheet material attaching between the ground tube and the float tube which is presented as folded but readily spread vertically as the flood waters rise, causing the float tube to rise to the water level while leaving the ground tube in contact with the ground surface forming a water proof barrier for the structure against the flood waters.

2. Description of Prior Art

A preliminary review of prior art patents was conducted by the applicant which reveal prior art patents in a similar field or having similar use. However, the prior art inventions do not disclose the same or similar elements as the present flood control apparatus, nor do they present the material components in a manner contemplated or anticipated in the prior art.

Several utility patents have addressed the problem of prevention of water build-up and protection of areas and structures using various disclosed methods and products. Some include walled barriers which are erected as waters rise. In U.S. Pat. No. 5,645,373 to Jenkins, a walled barrier with two ground inflatable ballast members securing to each other which support an extendable barrier wall, further supported by guy wires and poles, the tubular ballast members using water and air pressure. These ballast members are assisted by a liner, elongated plate retainers and spiral auger type anchors to keep the ballast members from floating and to keep the wall in place. A fluid filled barrier is provided in U.S. Pat. No. 5,856,564 to Miller, comprising a fluid-fillable barrier including a tubular, impermeable membrane and at least one tensioning member. The tensioning member is inside the barrier and separates the inner barrier to form the overall oval shape of the filled membrane. In U.S. Pat. No. 5,984,577 to Strong, two tubular cylinders are used, along with skirts. The upper tubular cylinder is inflated with air after the skirts are anchored to the ground. The lower cylindrical tube then obtains water from the flood through a plurality of linear spaced flood water entry ports to expand the lower cylindrical tube, resulting in an alleged effective flood barrier. A flood control barrier for separating water in a wet area and preventing water from entry into a dry area is shown in U.S. Pat. No. 6,551,025 to Dery. There is a flexible exterior membrane made of liquid impervious material and includes elongated upper and lower membrane sections joined at a closed longitudinal downstream end of the exterior membrane opposed to an open longitudinal upstream end, with water flowing into the open end and be received between the upper and lower membrane sections to be trapped within this device by the closed downstream end, preventing the water from flowing past the barrier. A flood wall is disclosed in U.S. Pat. No. 7,712,998 to Salemie, which comprises a portable flood wall by a sheet of synthetic plastic material folded back upon itself to define a chamber between bottom, rear and front portions of the sheet within which at least one inflatable bladder is secured. The bladder compels the rear portion of the sheet to rise into a vertical position to prevent water from passing beyond the sheet. The front portion contains a plurality of openings to allow water to enter the chamber. The weight of the water on the bottom portions of the sheet serves to hold the wall in place.

In another somewhat related apparatus, U.S. Pat. No. 5,197,821 to Cain, there is disclosed an oil spill containment boom that provides a boom curtain with a self-inflating flotation chamber on one longitudinal edge with an integral depending curtain terminating in a self-inflated ballast chamber also providing attached ballast weights, with the floatation chamber inflated by gas and the lower ballast chamber inflated by water into which the boom curtain is disposed. The boom curtain is made of al lightweight single-ply or multiple ply sheet material.

II. SUMMARY OF THE INVENTION

Over the last several years, land flooding has occurred due to hurricanes, torrential rains and other flooding occurrences in the south coastal regions, across the Midwest, in the deep south and on the west coast. In other words, just about every area in the country has experienced damaging and devastating floods. Within these floods buildings and structures become damaged not as often from walls of water, but from slowly rising water levels that by the sheer weight of the water seeping into the structures results in severe damage.

Traditional solutions include sandbag barriers which require a large amount of labor and time and are generally inadequate to provide damage relief to buildings. Therefore, a reliable solution is sought in the immediate flood barrier apparatus to provide the apparatus to be quickly deployable, easily removed after use, is durable and reusable, and that will provide efficient water protection to any structure from a flood up to 4 feet of water.

III. DESCRIPTION OF THE DRAWINGS

The following drawings are submitted with this utility patent application.

IV. DESCRIPTION OF THE PREFERRED EMBODIMENT

Figure 2:
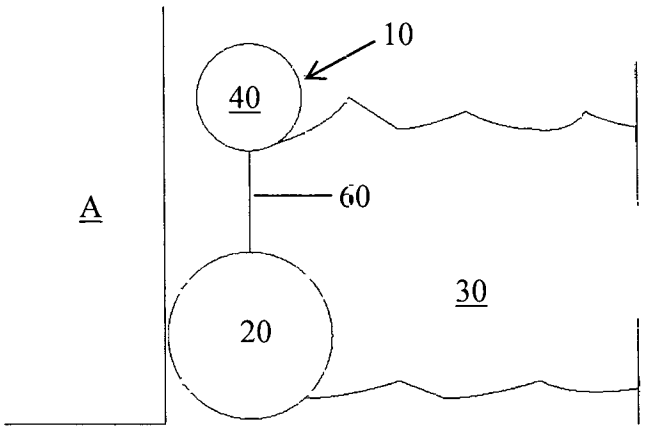
FIG. 2 is a side view of the flood control barrier against a structure during flooding.
Figure 1:
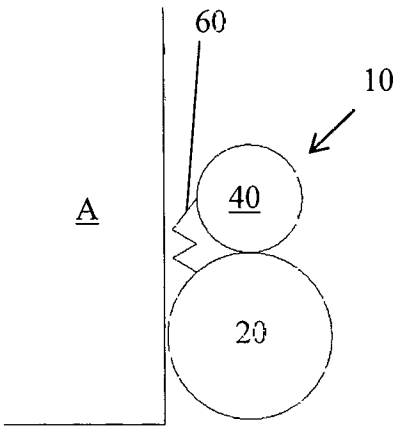
FIG. 1 is a side view of the flood control barrier against a structure prior to flooding.
Figure 3:
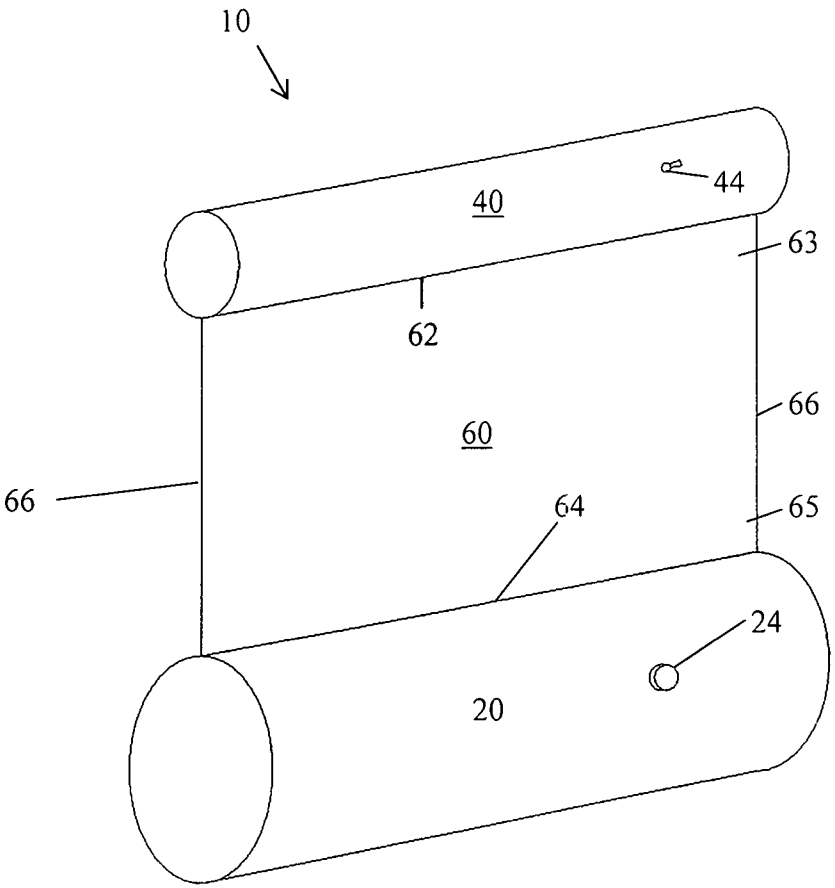
FIG. 3 is a perspective view of the flood control barrier in a deployed state.
Figure 5:
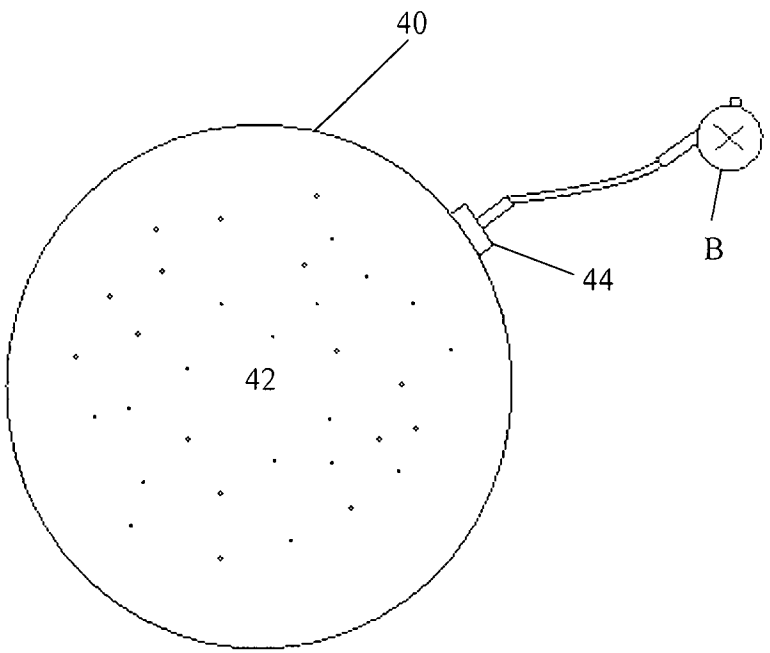
FIG. 5 is a cross sectional view of the upper floatation component containing air within the inner cavity.
Figure 4:
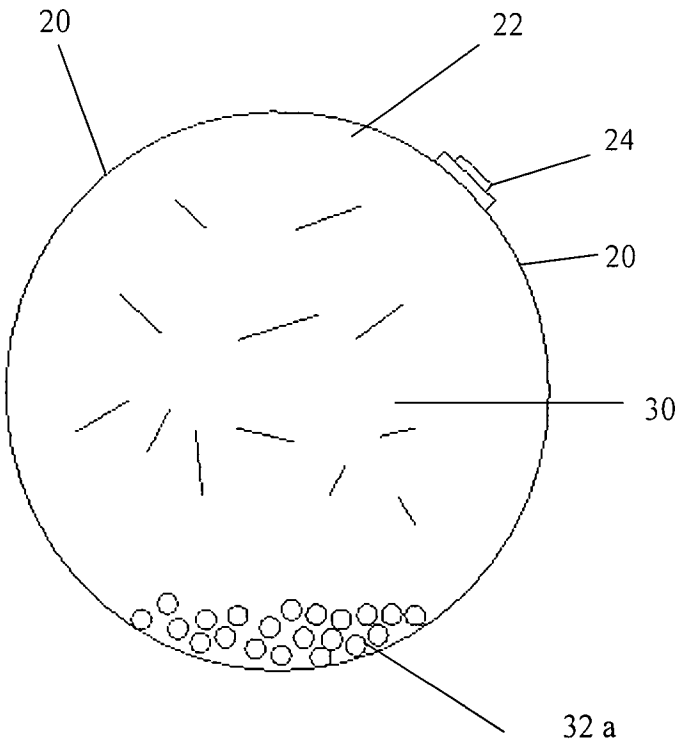
FIG. 4 is a cross sectional view of the lower ballast component containing ballast material and water within the interior cavity.
Figure 6:
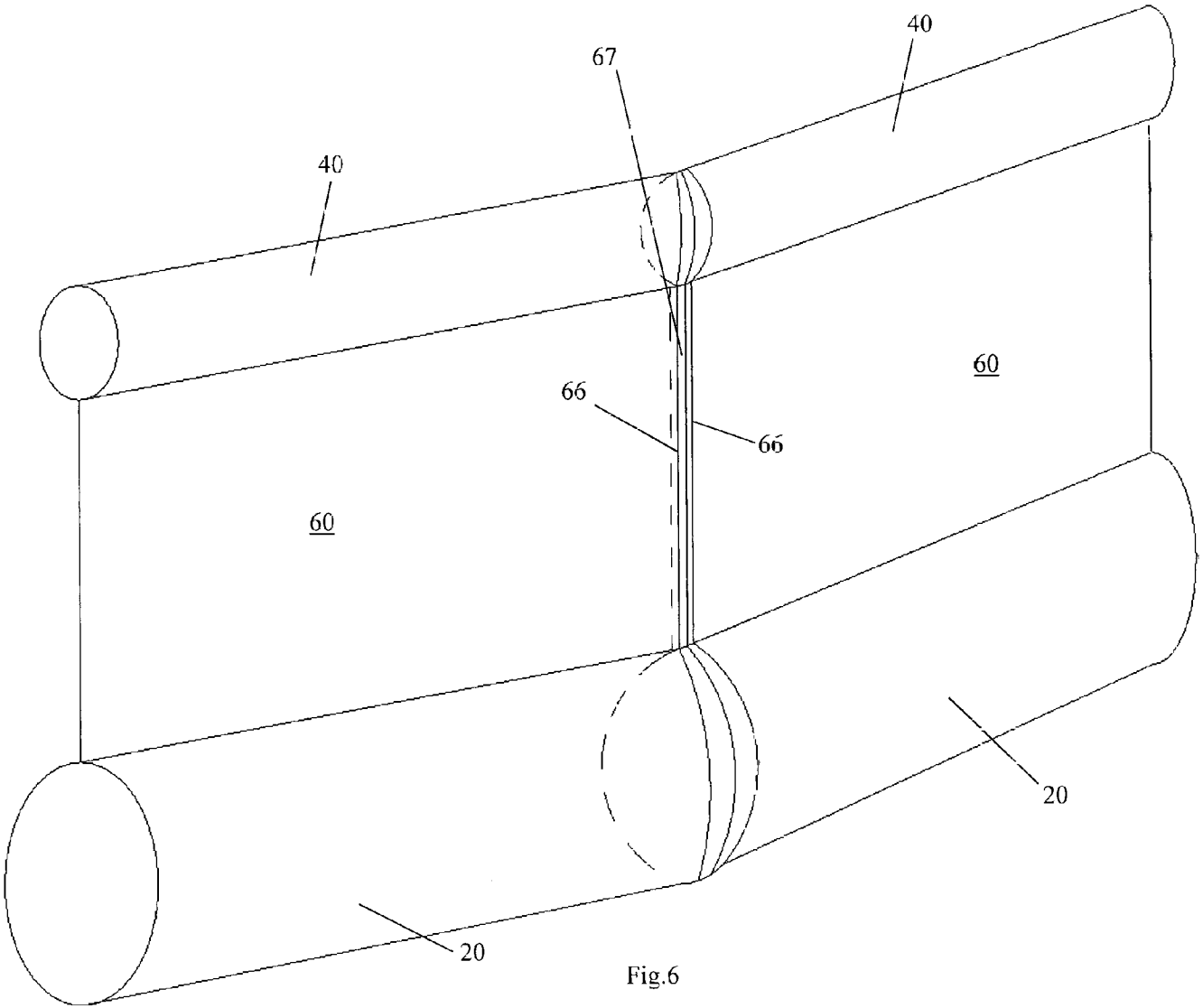
FIG. 6 is a view of two flood control barriers joined together at respective ends by an end connecting means.
Figure 8:
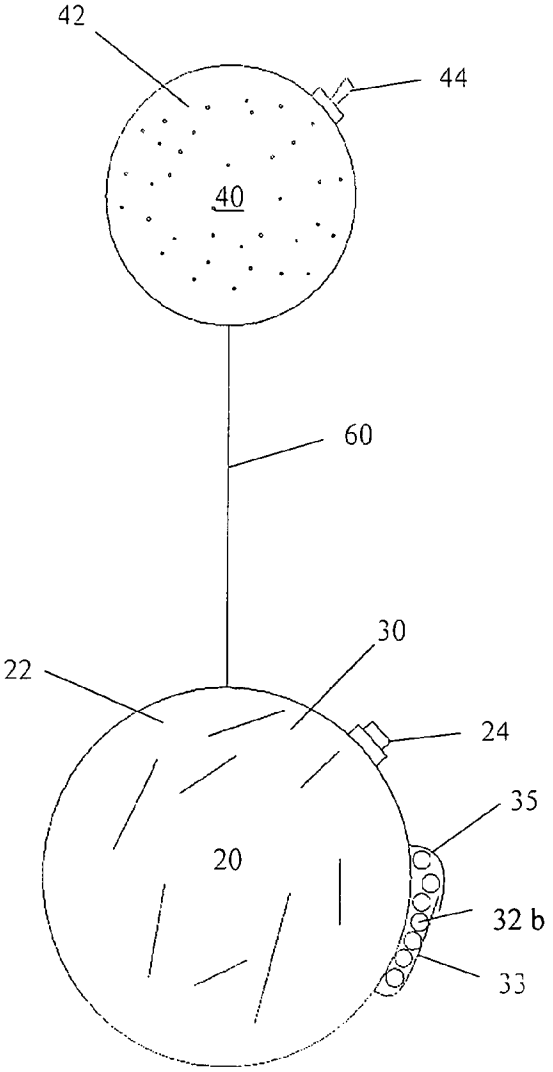
FIG. 8 is a side view of the flood control barrier with the lower ballast component containing an outer pocket and a pocket fold containing ballast material.
Figure 7:
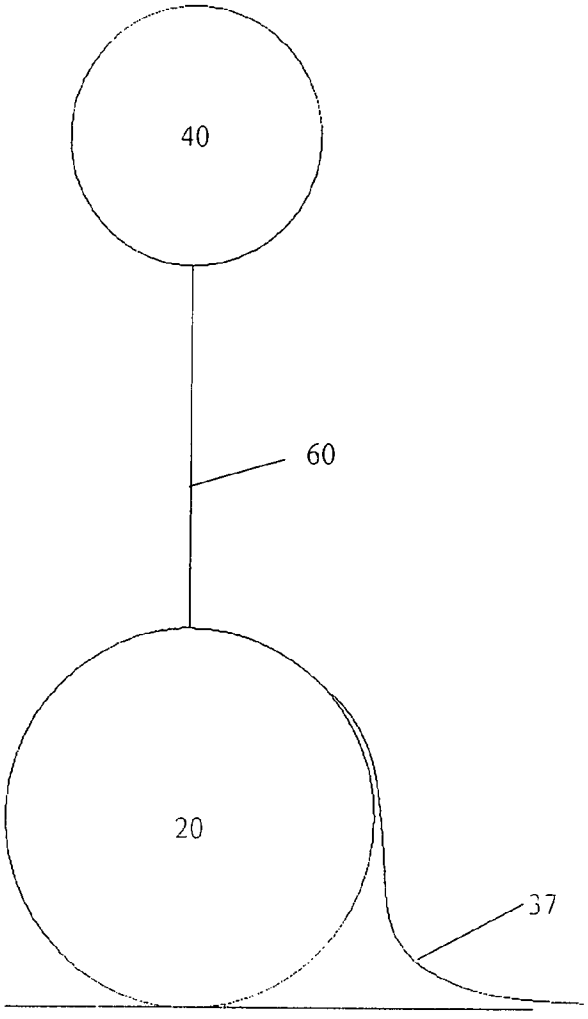
FIG. 7 is a side view of the flood control barrier with a ground connecting means embodied as a projecting apron with a ground stake attaching it to the ground below the flood control barrier.
Figure 10:
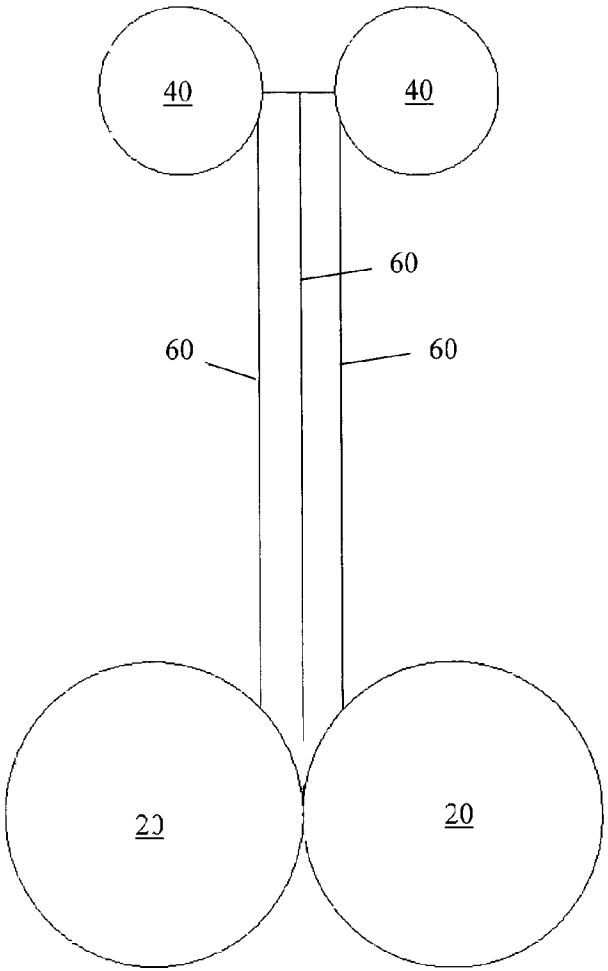
FIG. 10 is yet another embodiment of the flood control barrier having more than one lower ballast component, more than one upper floatation component, and more than one ply of protective fabric.
Figure 9:
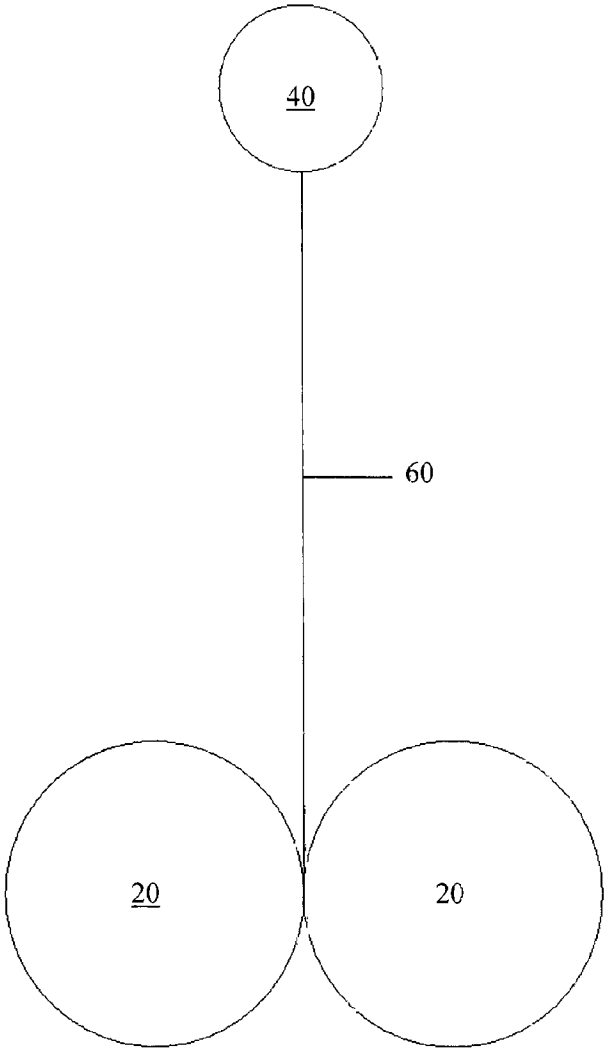
FIG. 9 is an embodiment of the flood control barrier having more than one lower ballast component and a single upper floatation component.

A portable and temporary flood control barrier 10 for the protection of a building structure A against ground flooding and rising water, as shown in FIGS. 1-10 of the drawings, the flood control barrier 10 comprising at least one lower ballast component 20 having an interior cavity 22 and a cavity access 24, at least one upper flotation component 40 defining an interior cavity 42 and at least one inflation valve 44, and a protective fabric 60 connecting between the at least one lower ballast component 20 and the at least one upper flotation component 40, wherein the flood control barrier 10, being flexible in a non-deployed state, is transported to the selected building structure A and placed on the ground against the building structure to exact deployment of the flood control barrier 10, FIG. 1. The interior cavity 22 of the at least one lower ballast component 20 is filled with water 30 and a ballast material 32*a*, FIG. 4, having a density greater than water through the at least one cavity access 24, the water 30 and ballast material 32*a* maintaining the at least one lower ballast component 20 below the flood water and in contact with the ground at all times during the flooding occurrence. The interior cavity 42 of the at least one upper floatation component 40 is filled with air through the at least one inflation valve 44 by an auxiliary air supply B, FIG. 5. As a result, the at least one upper floatation component 40, as the flood waters rise, will ascend to the top of the flood waters, while the at least one lower ballast component 20 remains in contact with the ground, the protective fabric 60 extending between the lower ballast component 20 and the upper floatation component 40, forming a protective barrier wall to prevent flood waters from entering the building structure A up to the full extended height of the flood control barrier 10, FIG. 2.

Several embodiments of the present flood control barrier 10 are contemplated within the scope of this invention. Included within these embodiments provides the flood control barrier with a single, double or plural number of lower ballast components 20 combining with a single, double or plural upper floatation component 40, along with a single ply, double play or multiple ply protective fabric 60, FIGS. 9-10. The material used to construct the components of the flood control barrier 10 would be a water proof fabric or material, and for cost effective production considerations, could be made of the same fabric throughout as well as made from a single sheet of fabric material sewn and segregated to form the lower ballast component 20, the protective fabric 60 and the upper floatation component 40.

As to the ballast material included in part with water 30 to fill the lower ballast component 20, the ballast material 32*a* may be a granular or particulate material that can pass through the cavity access both to load the lower ballast component prior to use or to unload the material after use. The contemplated ballast material can be sand, lead beads, steel beads, river rock, glass beads or any other collection of object materials that do not have sharp edges or ends to avoid rupture or piercing of the materials comprising the lower ballast component 20. It would be preferable that the materials be removed from the interior cavity 22 of the lower ballast component 20 after use to allow them and the interior cavity 22 of the at least one lower ballast component 20 to dry prior to storage. It may also be preferable that ballast material 32*b* be built into the lower ballast component 20, either through outer pockets 33 or within pocket folds 35 of the at least one lower ballast component 20, FIG. 8.

The at least one lower ballast component 20 is readily distinguishable from several prior art inventions due to the present at least one lower ballast component 20 containing materials other than water and thus has shown unexpected success and results over the prior art. The density of water being used to resist water itself can result in some degree of floatation of the lower ballast component, especially when the material used in the construction of a lower ballast component 20 is a plastic material, which is likely lighter than water and would act as a buoyant material, causing it to surge above the ground. By providing the ballast material 32*a* and 32*b* within the lower ballast component 20 with a density greater than water, the overall effect provides the lower ballast component 20 with a density greater than water, even if that density is less than 5% greater than water, assisting the lower ballast component 20 in remaining below the surface of rising waters and remaining in contact with a ground surface.

The contemplated shapes of the at least one lower ballast component 20 and the at least one upper floatation component 40 are irrelevant, but they are preferably elongated tubular components that are equal in length. In an embodiment having a single upper floatation component 40 and one lower ballast component 20, the protective fabric 60 is secured to the upper floatation component 40 by a water-proof upper seam 62 connecting an upper margin 63 of the protective fabric 60 to the upper floatation component 40 and a lower margin 65 of the protective fabric 60 is secured to the lower ballast component 20 along a water-proof lower seam 64. To be effective, the flood control barrier 10 should be partially flexible during deployment to allow the flood control barrier 10 to conform to the building structure A against which it is placed and also to allow it to bend, if necessary, around corners of the building structure A. In the event, the building structure is overly irregular is shape, it is contemplated that the flood control barrier 10 provide side ends 66 with an end connecting means 67 which connect the side end of each flood control barrier 10 to the side end 66 of another flood control barrier 10 in a manner providing for at least a 90 degree angle to wrap around a corner of the building structure A. It is further contemplated within the scope of the flood control barrier that using these end connection means 67, FIG. 6, an entire perimeter of the building structure A can be surrounded by a series of connected flood control barriers 10, with the series of flood control barriers 10 protecting the building structure A along all sides against flood waters. Essentially, the end connection means could be as simple as duct tape and as complex as a zipper, linear interlocking (ZIPLOCK®) seam, or some other known water-proof linear sealing means.

It is also contemplated that the flood control barrier 10 may employ one or more ground attaching means 37 to maintain the at least one lower ballast component 20 in an intended location on the ground during its use, especially where tidal flooding or wave flooding is occurring. These one or more ground attaching means 37 may be provided as tab extensions emanating from the lower ballast component 20 having a grommet, an apron extending from the lower ballast component 20 providing a series of grommets, FIG. 7, or guy ropes, each ground attaching means 37 secured to the ground by stakes, ground anchors, stone blocks or sand bags laid on the lower ballast component 20 on the apron, by metal rods or pipes inserted through fabric loops, or even providing the tab extensions or apron grommets attached to the building structure by screws, nails or hooks along the lower building structure, the specific ground attaching means not shown in the drawings in the various listed embodiments, but contemplated within the scope of the definition of the ground attaching means 37.

In testing conducted by the inventors, it has been found that building structures A can withstand the force of water with little or no structural damage up to 4 feet of water. Beyond that height, the force of the water can damage a building structure A by it weight and force, however dependant on the materials and quality of construction of the building structure A. It is also important that the floor control barrier 10 be made of a durable material—otherwise it is nothing more that a poor product. The inventors have found through testing that a material having a strength equal to or greater than 3.5 mm VISQUEEN® or other polymeric sheet fabric be used for construction of the flood control barrier in order to withstand the pressure forces of at least four feet of water without deformity, penetration or tearing, especially at any seam or joint and may include an incorporated netting or mesh material for added strength. Scams or joints must be water-proof and should be made of a strong adhesive material (duct tape), compatible glue or cement, heat sealing or lamination, or other means used to seal water-proof fabrics and would be entirely dependant on the choice of fabrics and materials used in the construction of the flood control barrier 10 and its respective components.

While the present flood control barrier has been particularly shown and described with reference to a preferred embodiment thereof, it will be understood by those skilled in the art that changes in form and detail may be made therein without departing from the spirit and scope of the invention.

What is claimed is:

1. A portable and temporary flood control barrier for the protection of a building structure against ground flooding and rising water, said flood control barrier comprising:

at least one lower ballast component defining an interior cavity and a cavity access;

at least one upper floatation component defining an interior cavity and an inflation valve;

at least one sheet of protective fabric comprising an upper margin and a lower margin, said at least one sheet of protective fabric attached along said upper margin to said at least one upper floatation component and along said lower margin to said at least one lower ballast component;

a ballast material heavier than water disposed along with water within said interior cavity of said at least one lower ballast component, wherein in use, the ballast material is inserted into said interior cavity of said at least one lower ballast component through said cavity access and combined with said water to fill said interior cavity of said at least one lower ballast component;

an outer pocket and a pocket fold integrated with said at least one lower ballast component and containing additional ballast material; and an auxiliary air supply, wherein in use, said upper floatation component is filled with air from the auxiliary air supply through said inflation valve, wherein said flood control barrier is configured to be placed against said building structure prior to said ground flooding or rising water and is configured such that during said flooding or rising water, said at least one upper floatation component rises to the top of said flooding or rising water while said at least one lower ballast component remains in contact with the ground in front of said building structure and said at least one sheet of protective fabric extends to provide a barrier against said flood or rising water.

2. The flood control barrier as specified in claim 1, wherein:

said lower ballast component is connected to a ground attaching means.

3. The flood control barrier as specified in claim 1, wherein:

each said at least one sheet of protective fabric defines outer ends, each of said outer ends attached to an end connecting means, said end connecting means configured to connect said flood control barrier to at least another said flood control barrier for placement against said building structure, and said end connecting means configured to allow said connected flood control barriers to bend to conform to said building structures that are non-linear.

4. The flood control barrier as specified in claim 1, wherein:

said ballast materials are heavier than water and are also granular or particulate materials that are capable of passing through said cavity access to load said ballast materials into said at least one lower ballast component prior to use and unload said ballast materials from said at least one lower ballast component after use, said ballast materials selected from the group of materials consisting of sand, lead beads, steel beads, river rock, glass beads, and any materials that do not have sharp edges or ends such that said ballast materials avoid rupture or piercing of said lower ballast component.

* * * * *